US009610702B2

(12) United States Patent
Hutsell

(10) Patent No.: US 9,610,702 B2
(45) Date of Patent: Apr. 4, 2017

(54) CHAIN SAW CUTTER LINKS

(71) Applicant: Blount, Inc., Portland, OR (US)

(72) Inventor: Sam Hutsell, Portland, OR (US)

(73) Assignee: BLOUNT, INC., Portland, OR (US)

( * ) Notice: Subject to any disclaimer, the term of this patent is extended or adjusted under 35 U.S.C. 154(b) by 0 days.

(21) Appl. No.: 14/530,446

(22) Filed: Oct. 31, 2014

(65) Prior Publication Data

US 2016/0121511 A1 May 5, 2016

(51) Int. Cl.
*B27B 33/14* (2006.01)

(52) U.S. Cl.
CPC ..... *B27B 33/142* (2013.01); *B27B 33/141* (2013.01); *Y10T 83/909* (2015.04); *Y10T 83/925* (2015.04)

(58) Field of Classification Search
CPC ..... B27B 33/14–33/148; Y10T 83/909; Y10T 83/913; Y10T 83/917; Y10T 83/921; Y10T 83/925
USPC ..... 83/830–834
See application file for complete search history.

(56) References Cited

U.S. PATENT DOCUMENTS

| | | | | | |
|---|---|---|---|---|---|
| 3,910,148 | A * | 10/1975 | Weiss | B27B 33/141 | 83/833 |
| 4,581,968 | A | 4/1986 | Gibson | | |
| 4,590,836 | A * | 5/1986 | Doiron | 83/834 | |
| 4,841,825 | A | 6/1989 | Martin | | |
| 5,092,211 | A * | 3/1992 | Petrovich et al. | 83/830 | |
| RE37,288 | E * | 7/2001 | Burrows | B23D 61/021 | 83/830 |
| 6,837,138 | B2 * | 1/2005 | Mang | 83/830 | |

FOREIGN PATENT DOCUMENTS

| | | |
|---|---|---|
| EP | 0304256 A1 | 2/1989 |
| EP | 0865886 A2 | 9/1998 |

* cited by examiner

*Primary Examiner* — Laura M Lee
(74) *Attorney, Agent, or Firm* — Schwabe Williamson & Wyatt, P.C.

(57) ABSTRACT

Embodiments of chain saw cutter links, and related apparatuses and methods. For example, in some embodiments, a cutter link may include a top plate, a sharpened surface having an upper end and a lower end, and a depth gauge having a top surface. The sharpened surface may define a reference line tangent to the sharpened surface at the upper end such that the reference line extends between the top plate and the sharpened surface, a sharpened width may be defined by a minimum distance between the reference line and the lower end of the sharpened surface, an opening width may be defined by a minimum distance between the reference line and the top surface of the depth gauge, and the sharpened width may be greater than the opening width.

14 Claims, 8 Drawing Sheets

CHAIN SAW CUTTER LINKS

TECHNICAL FIELD

The present disclosure relates generally to the field of chain saws, and more particularly, to chain saw cutter links.

BACKGROUND

Chain saws typically include a housing containing a driving device (e.g., an engine), a guide bar extending from the housing, and a saw chain that is driven by the driving device around the perimeter of the guide bar. The saw chain may include different types of links arranged in different configurations. Some of the links included in a saw chain may be cutter links having a sharpened portion for cutting through media (e.g., wood).

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, and not by way of limitation, in the figures of the accompanying drawings.

DETAILED DESCRIPTION

Embodiments of chain saw cutter links, and related apparatuses and methods, are disclosed herein. The cutter links disclosed herein may improve chain saw cutting performance by cutting through the desired media (e.g., wood) more quickly and smoothly than conventional cutter links. In particular, the cutter links disclosed herein may improve the cutting efficiency of a chain saw, a measure that quantifies the ability of the saw chain to convert the power provided by the saw into the speed of a cut and the removal of material.

Figure 2:
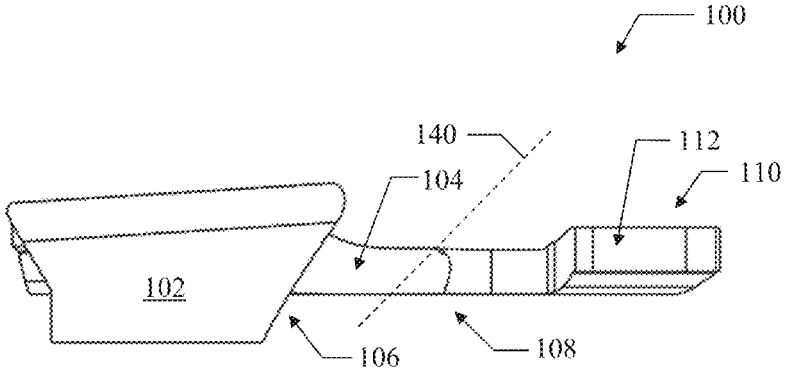

Manufacturers have traditionally focused on three dimensions when designing cutter links: the hook angle (also referred to as the side plate angle, measured between the "vertical" tangent to the upper end of the sharpened surface and the plane of the bottom of the toe and heel of the link), the top plate angle (measured between the "horizontal" tangent to the upper end of the sharpened surface and an axis normal to the side face of the link), and the down angle (measured between the sharpening axis, as illustrated in FIG. 2, and a line within the plane of the sharpening axis and normal to the plane of the side face of the link).

Disclosed herein are new geometries for chain saw cutter links. These new geometries are defined by angles and distances previously unrecognized as relevant to chain saw efficiency, and may provide significant performance improvements over conventional cutter links.

Not only are the cutter link geometries disclosed herein new, but the techniques used to enable the cost-effective and reliable manufacturing of various embodiments of the cutter links have only recently been developed, as discussed in further detail below.

In the following detailed description, reference is made to the accompanying drawings that form a part hereof wherein like numerals designate like parts throughout, and in which is shown by way of illustration embodiments that may be practiced. It is to be understood that other embodiments may be utilized and structural or logical changes may be made without departing from the scope of the present disclosure. Therefore, the following detailed description is not to be taken in a limiting sense.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C). The description uses the phrases "in an embodiment," or "in embodiments," which may each refer to one or more of the same or different embodiments. Furthermore, the terms "comprising," "including," "having," and the like, as used with respect to embodiments of the present disclosure, are synonymous.

Figure 1:
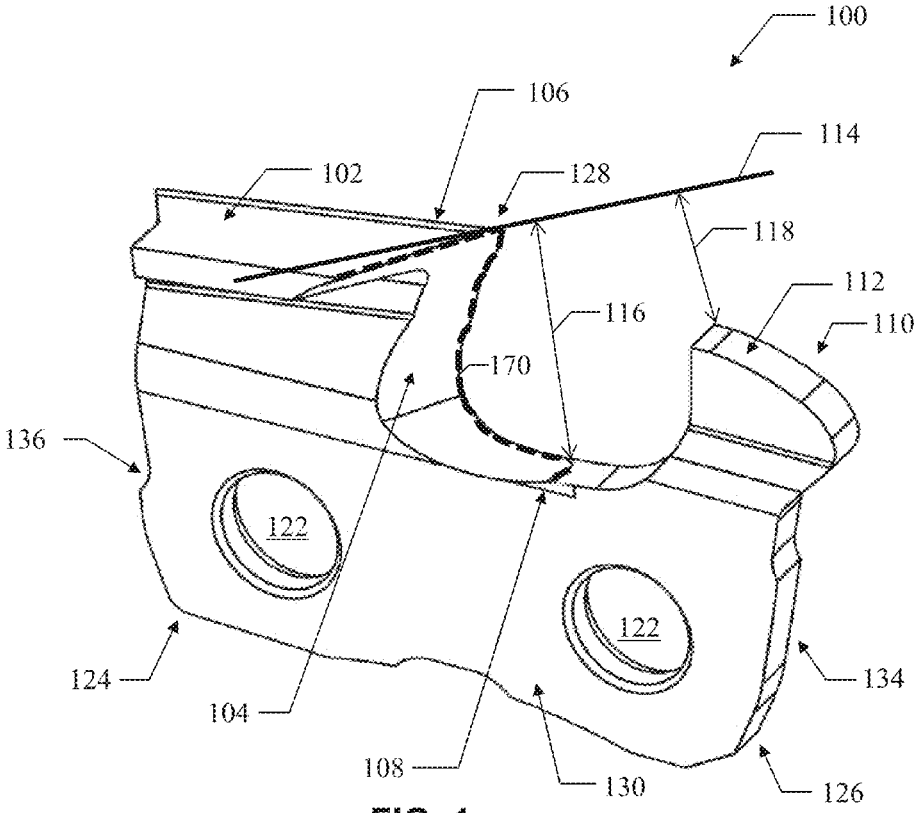
FIGS. 1-4 are various views of a cutter link for a chain saw, in accordance with various embodiments.

FIG. 1 is a perspective view of a cutter link 100 for a chain saw, in accordance with various embodiments. The cutter link 100 illustrated in FIG. 1 may be a left-hand cutter link, shaped to be positioned on a particular side of a saw chain as understood in the art. The cutter link 100 may be formed of hardened steel or any other suitable material. Some of the surfaces of the cutter link 100 may be coated or plated. For example, some surfaces different from the sharpened surface 104 may be chrome-plated.

Figure 10:
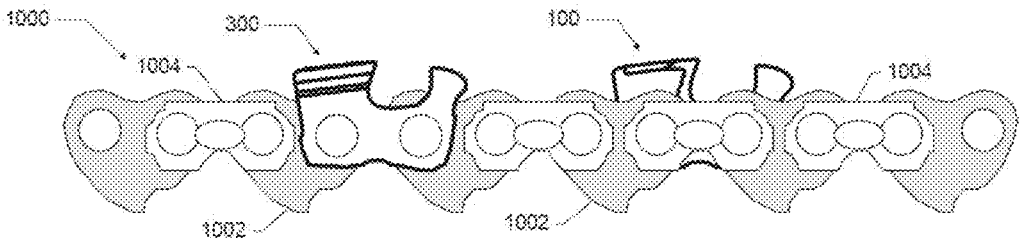
FIG. 10 is a side view of a saw chain including the cutter link of FIGS. 1-4 and 6-9, in accordance with various embodiments.

The cutter link 100 may include a first end 134 and an opposing second end 136. The toe 126 of the cutter link 100 may be disposed at the first end 134, and a heel 124 of the cutter link 100 may be disposed at the second end 136. The cutter link 100 may have a first side face 130 and an opposing second side face 132 (facing away from the viewer of FIG. 1, but shown in FIG. 4). One or more rivet holes 122 may extend between the first side face 130 and the second side face 132, and may be used to secure the cutter link 100 to a saw chain (e.g., as illustrated in FIG. 10).

The cutter link 100 may include a top plate 102. The top plate 102 may be disposed proximate to the second end 136 of the cutter link 100 and opposite from the heel 124. As shown, the top plate 102 may extend away from the first side face 130.

The cutter link 100 may also include a sharpened surface 104. The sharpened surface 104 may have an upper end 106 and a lower end 108. The upper end 106 of the sharpened surface 104 may also define the edge of the top plate 102 closest to the first end 134 of the cutter link 100. The corner of the upper edge 106 of the sharpened surface 104 at the second side face 132 may be referred to as the cutting corner 128. The sharpened surface 104 may "curve" from its upper end 106 to its lower end 108 (e.g., with compound curvature), and may provide the cutting surface of the cutter link 100 when the cutter link 100 is in use in a saw chain, as understood in the art.

The cutter link 100 may include a depth gauge 110. The depth gauge 110 may be disposed proximate to the first end 134 of the cutter link 100 and opposite from the toe 126. The depth gauge 110 may have a top surface 112.

FIG. 2 is a top view of the cutter link 100, illustrating the top plate 102, the sharpened surface 104, the upper end 106 of the sharpened surface 104, the lower end 108 of the sharpened surface 104, the depth gauge 110, and the top surface 112 of the depth gauge 110. FIG. 2 also illustrates a sharpening axis 140. As used herein, the sharpening axis 140 may represent an axis along which an axially symmetric sharpening tool (e.g., a grinder) may be positioned in order to sharpen the sharpened surface 104 (e.g., during the lifetime of the cutter link 100) at the upper end 106 of the sharpened surface 104. The radius of curvature of the sharpening tool, when axially aligned with the sharpening axis 140, may thus match the radius of curvature of the sharpened surface 104 at the upper end 106.

Figure 3:
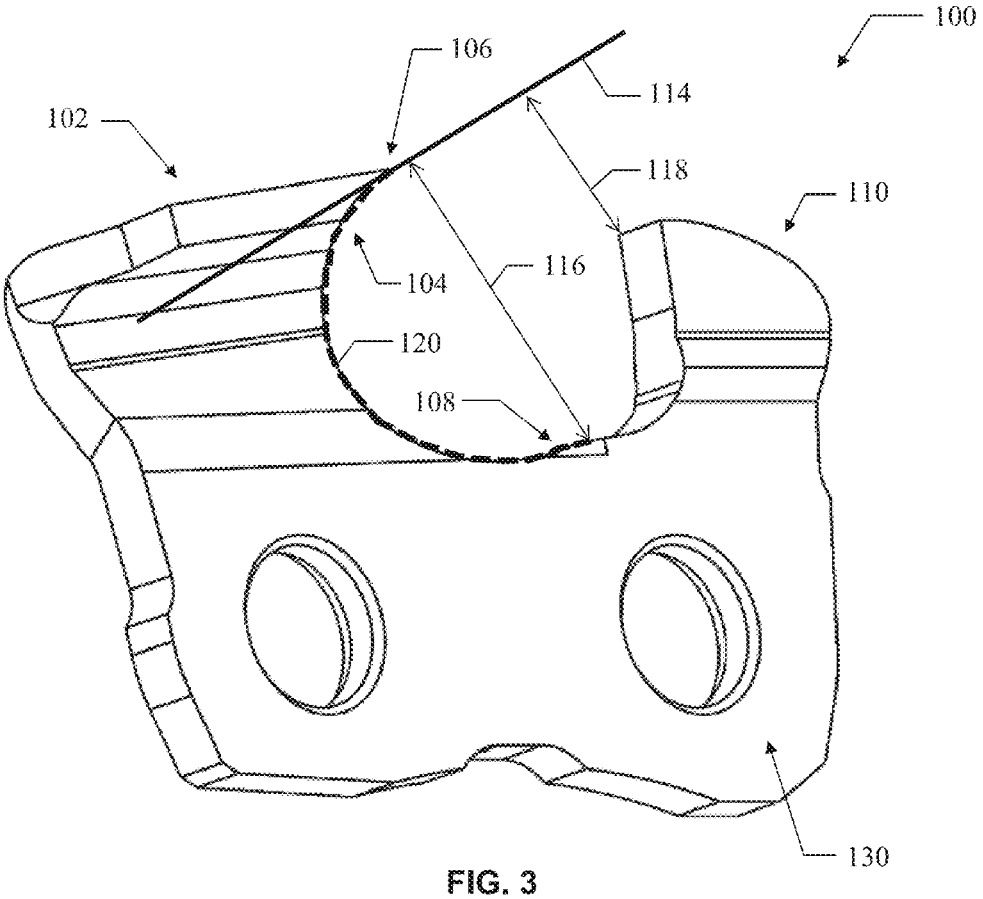

FIG. 3 is a second perspective view of the cutter link 100, illustrating the first side face 130, the top plate 102, the depth gauge 110, the upper end 106 of the sharpened surface 104, and the lower end 108 of the sharpened surface 104.

Figure 4:
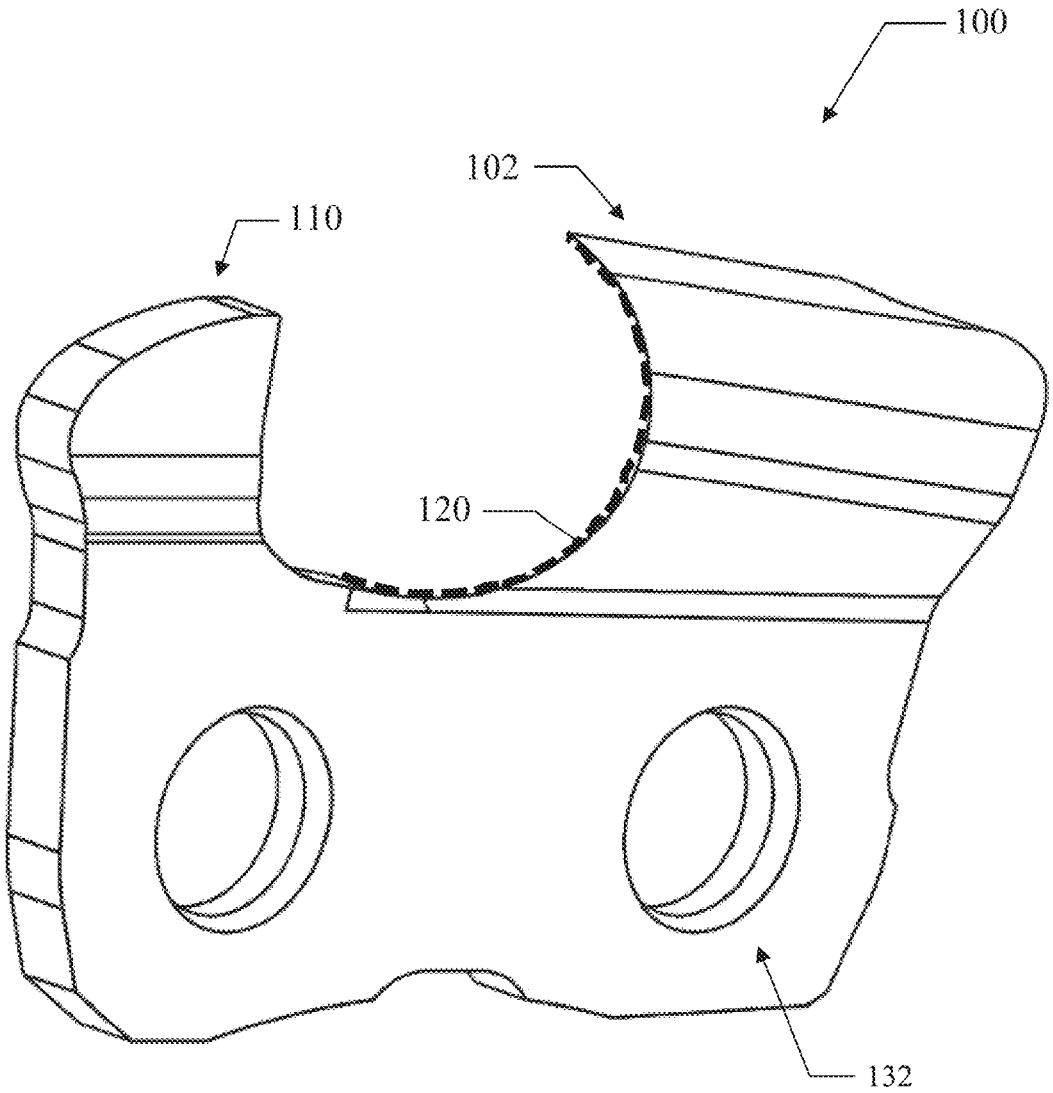

FIG. 4 is a third perspective view of the cutter link 100, illustrating the second side face 132 (opposite to the first side face 130), the depth gauge 110, and the top plate 102.

The curvature of the sharpened surface 104 may define a reference line 114 (illustrated in FIGS. 1 and 3). The reference line 114 may be defined as a line tangent to the sharpened surface 104 at the upper end 106 such that the reference line 114 extends between the top plate 102 and the sharpened surface 104 (as best illustrated in FIG. 3). The reference line 114 may thus extend "over" the top surface 112 of the depth gauge 110.

The reference line 114 may enable the definition of a number of useful dimensions of the cutter link 100. For example, a sharpened width 116 may be defined as the minimum distance between the reference line 114 and the lower end 108 of the sharpened surface 104. An opening width 118 may be defined as the minimum distance between the reference line 114 and the top surface 112 of the depth gauge 110. The opening width 118 may control the maximum thickness of separated media (e.g., a wood chip) from the base media.

Another useful dimension defined with reference to the sharpened surface 104 is the arc length 120 (illustrated as the dotted contours in FIGS. 3 and 4). As used herein, the arc length 120 is defined as the length of the projection of the upper end 106 of the sharpened surface 104, and all edges of the sharpened surface 104 that are tangent to the upper end 106, onto a plane oriented normal to the sharpening axis 140. FIG. 1 includes a contour 170 that includes the upper end 106 of the sharpened surface 104 and all edges of the sharpened surface 104 that are tangent to the upper end 106. The contour 170 extends to the first side face 130 at the lower end 108 of the sharpened surface 104. In this embodiment, the arc length 120 is the length of the projection of the contour 170 onto a plane normal to the sharpening axis 140. The perspective views of FIGS. 3 and 4 are taken from planes normal to the sharpening axis 140 (in other words, the planes of the pages on which FIGS. 3 and 4 are represented are normal to the sharpening axis 140) and thus the arc length 120 is the length of the dotted curve shown.

The cutting performance of the cutter link 100 may be a function of a number of different relationships among various dimensions of the cutter link 100. In some embodiments, a cutter link 100 having a sharpened width 116 that is greater than its opening width 118 may provide improved cutting performance relative to a cutter link having a sharpened width that is less than its opening width. An example of such a relationship between the sharpened width 116 and the opening width 118 is explicitly illustrated in FIGS. 1 and 3.

Performance advantages may be seen for cutter links of any suitable dimensions having a sharpened width greater than an opening width. For example, in some embodiments, the ratio of the opening width to the sharpened width may be approximately 0.56 (e.g., +/−0.07 around this nominal value). In some embodiments, the opening width (e.g., the opening width 118) may be approximately 0.129 inches (e.g., +/− approximately 0.010 inches around this nominal value). In some embodiments, the sharpened width (e.g., the sharpened width 116) may be approximately 0.231 inches (e.g., +/− approximately 0.010 inches around this nominal value).

Another relationship between dimensions that may correspond to cutting performance may be the ratio of the opening width (e.g., the opening width 118) to the arc length of the sharpened surface (e.g., the arc length 120). This ratio may be referred to herein as the "chip drag coefficient." In some embodiments, a chip drag coefficient that is less than or equal to approximately 0.55 (e.g., +/−0.025 around this nominal value) may provide improved cutting performance relative to a cutter link having a chip drag coefficient greater than 0.55.

Performance advantages may be seen for cutter links of any suitable dimensions having a chip drag coefficient less than or equal to approximately 0.55. For example, in some embodiments, the chip drag coefficient may be less than or equal to approximately 0.45 (e.g., +/−0.05 or less around this nominal value). In some embodiments, the chip drag coefficient may be equal to approximately 0.37 (e.g., +/−0.025 around this nominal value). In some embodiments, the arc length (e.g., the arc length 120) may be approximately 0.346 inches (e.g., +/− approximately 0.38 inches).

A cutter link may exhibit improved performance over conventional cutter links when it has a sharpened width greater than an opening width, even if it does not have a chip drag coefficient less than or equal to approximately 0.55. Similarly, a cutter link may exhibit improved performance over conventional cutter links when it has a chip drag coefficient less than or equal to approximately 0.55, even if it does not have a sharpened width greater than an opening width. In some embodiments, a cutter link may have a sharpened width greater than an opening width and a chip drag coefficient less than or equal to approximately 0.55. For example, although the cutter link 100 of FIG. 1 may have a sharpened width 116 greater than an opening width 118, and may have a chip drag coefficient less than or equal to approximately 0.55, not all embodiments of the advantageous cutter links disclosed herein may have both properties.

Figure 5:
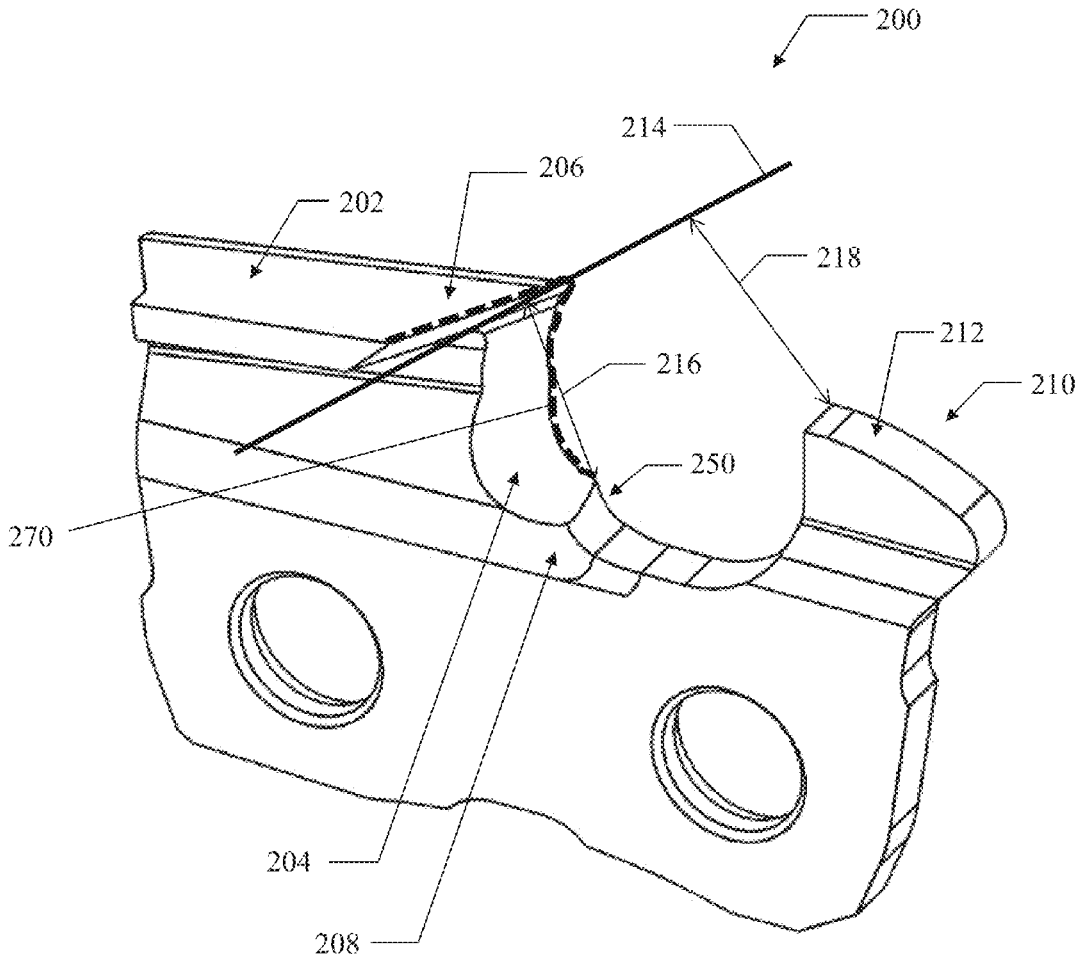
FIG. 5 (PRIOR ART)
FIG. 5 is a perspective view of a prior art cutter link.

FIG. 5 is a perspective view of a prior art cutter link 200, which may include many components analogous to those included in the cutter link 100 but with different relative and absolute dimensions. For example, the cutter link 200 may include a top plate 202, a sharpened surface 204 having an upper end 206 and a lower end 208, and a depth gauge 210 having a top surface 212. As shown, the lower end 208 of the sharpened surface 204 may be a tooth 250 that forms a distinct corner at the lower end 208. The tooth 250 is typically an artifact of the grinding process used to form the sharpened surface 204, and often is manually removed by a chain saw user (e.g., using a file) when the user sharpens or refreshes the chain.

The sharpened surface 204 may have a contour 270, as indicated by the dotted contour in FIG. 5, and the contour 270 and the sharpening axis of the cutter link 200 (not shown) may define an arc length for the cutter link 200 as described above with reference to the arc length 120 of the cutter link 100. The curvature of the sharpened surface 204 may define a reference line 214 defined as a line tangent to the sharpened surface 204 at the upper end 206 such that the reference line 214 extends between the top plate 202 and the sharpened surface 204 (as also discussed above with reference to the cutter link 100). A sharpened width 216 of the cutter link 200 may be defined as the minimum distance between the reference line 214 and the lower end 208 of the sharpened surface 204, and an opening width 218 may be defined as the minimum distance between the reference line 214 and the top surface 212 of the depth gauge 210 (analogously to the dimensions discussed above with reference to the cutter link 100).

As shown in FIG. 5, the sharpened width 216 of the cutter link 200 may be less than the opening width 218. Additionally, the chip drag coefficient of the cutter link 200 (defined as the ratio between the opening width 218 and the arc length of the cutter link 200, as discussed above) may be greater than approximately 0.55. The cutter links 100 disclosed herein (e.g., those having a sharpened width greater than an opening width and/or a chip drag coefficient less than or equal to approximately 0.55) may exhibit improved performance over conventional cutter links, such as the cutter link 200.

As noted above, the cutter links disclosed herein (e.g., the cutter link 100) have new geometries that are defined by angles and distances previously unrecognized as relevant to chain saw efficiency (e.g., the sharpened width, the opening width, the arc length, and the relationships between them), and may provide significant performance improvements over conventional cutter links. In particular, the cutter links disclosed herein may increase the efficient movement of the separated media (e.g., wood chips) away from the base media so that more of the saw's power is available for cutting (and not wasted in overcoming the resistance imposed by the separated media accumulating in a corkscrew fashion near the sharpened surface, for example).

Conventional cutter links, like the cutter link 200, have a comparatively short arc length (e.g., based on the contour 270) and an abrupt lower end to the sharpened surface (e.g., the tooth 250 located at the lower end 208 of the sharpened surface 204). As illustrated in FIG. 5, the contour 270 may end at one end of the tooth 250. These features tend to restrict the flow of the separated media away from the sharpened surface, reducing efficiency. Additionally, the sharpened surface may not extend far enough "downward" to direct away the separated media that can fit between the top plate 202 and the depth gauge 210. In particular, having a negative difference between the sharpened width and the opening width (i.e., when the sharpened width is less than the opened width) may fail to effectively transport separated media away from the sharpened surface without adding to the maximum "chip" size that may be generated.

Various embodiments disclosed herein (i.e., those having a positive difference between the sharpened width and the opening width) may improve efficiency. Additionally or instead of these sharpened width/opening width performance gains, various embodiments disclosed herein having a coefficient of chip drag less than or equal to approximately 0.55 may exhibit a rate of increase in cutting efficiency for a given decrease in the coefficient of chip drag that is substantially greater than a decrease of the same magnitude from a coefficient value greater than approximately 0.55. These geometric constraints may provide performance improvements to any suitable form of hooded cutter link.

Additionally, as noted above, the techniques used to enable the cost-effective and reliable manufacturing of various embodiments of the cutter links have only recently been developed. For example, conventional grinding tools (traditionally used to cost-effectively form the sharpened surface of a cutter link) do not have the degrees of freedom necessary to achieve a sharpened width greater than an opening width. Forming such a cutter link in a reliable and cost-effective manner may involve the use of specialized tooling (e.g., multi-axis grinders) not previously available.

Various ones of the cutter link embodiments disclosed herein may improve cutting performance without sacrificing the expected lifetime of a cutter link. This lifetime is typically determined by the number of sharpenings (e.g., with a round, pencil-like file) that a cutter link can endure before the sharpened surface recedes too far for the cutter link to be useful. Conventionally, the thickness of the sharpened surface was increased to nominally extend the lifetime of a cutter link without any regard for the relative geometries of the cutter link (and the attendant effects on cutting performance). The geometries disclosed herein may enable cutter links to maintain a "thick" sharpened surface that can withstand repeated sharpenings while achieving some or all of the performance improvements described herein.

FIGS. 6-9 are additional views of the cutter link 100 of FIG. 1, in accordance with various embodiments.

Figure 6:
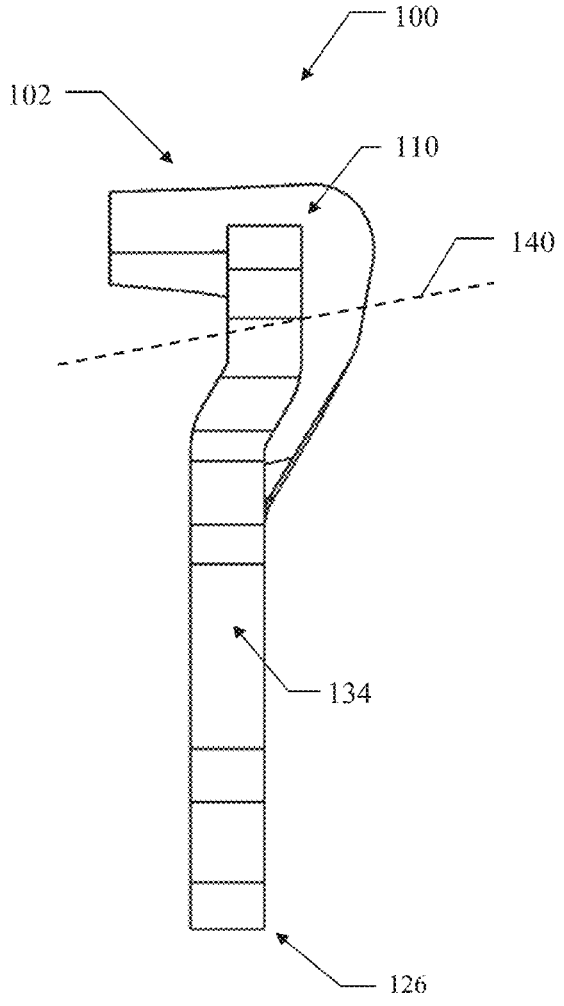
FIGS. 6-9 are additional views of the cutter link of FIGS. 1-4, in accordance with various embodiments.

In particular, FIG. 6 is an end view of the cutter link 100, illustrating the first end 134, the toe 126, the top plate 102, and the depth gauge 110. FIG. 6 also illustrates the sharpening axis 140. The down angle of the cutter link 100 may be measured such that a "horizontal" sharpening axis 140 in FIG. 6 corresponds to a down angle of 0 degrees.

Figure 7:
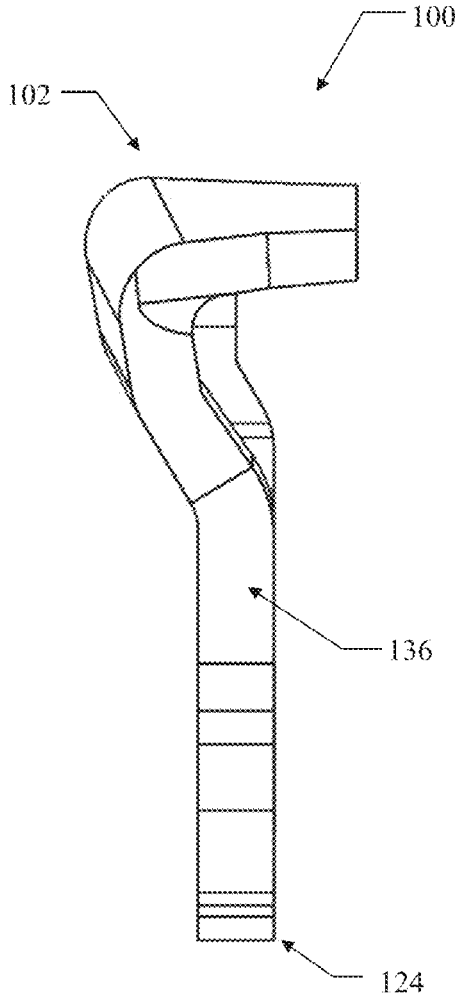

FIG. 7 is an end view of the cutter link 100, illustrating the second end 136, the heel 124, and the top plate 102.

Figure 8:
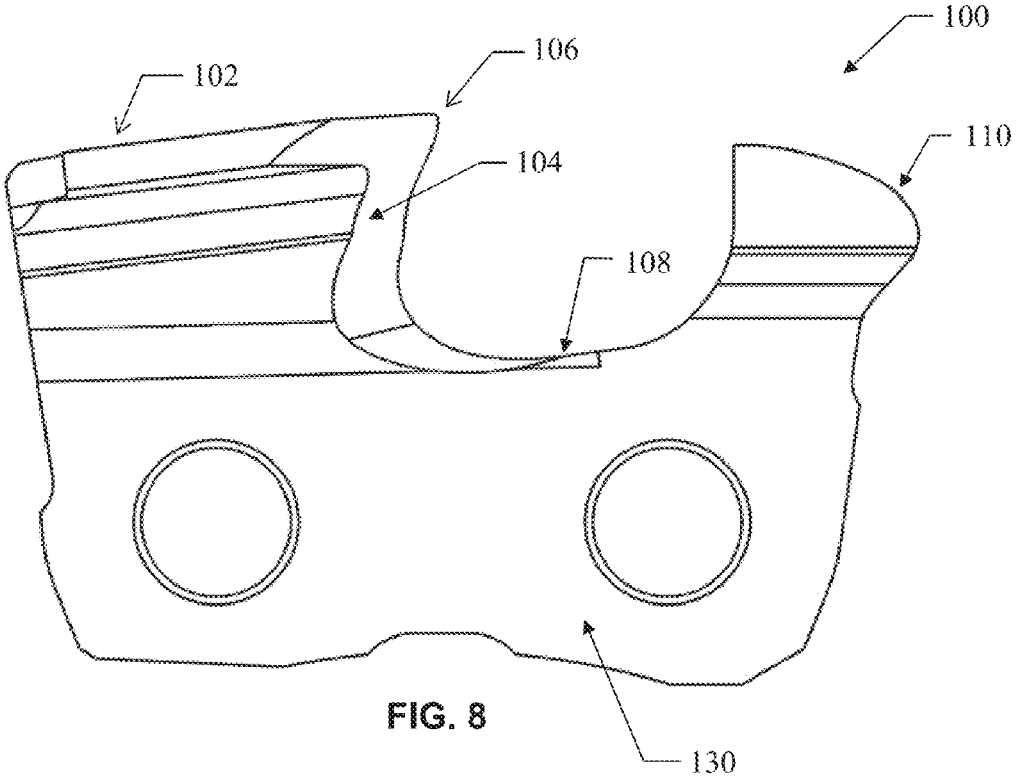

FIG. 8 is a side view of the cutter link 100, illustrating the first side face 130, the top plate 102, the sharpened surface 104 (and its upper end 106 and its lower end 108), and the depth gauge 110.

Figure 9:
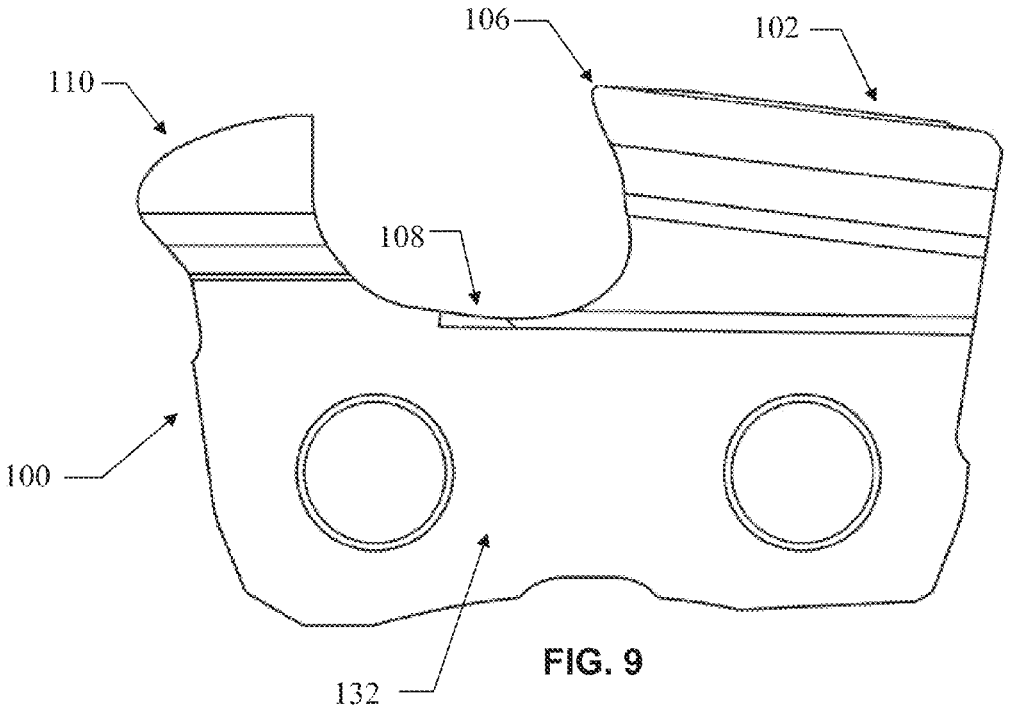

FIG. 9 is a side view of the cutter link 100, illustrating the second side face 132, the top plate 102, the upper end 106 of the sharpened surface 104, the lower end 108 of the sharpened surface 104, and the depth gauge 110.

FIG. 10 is a side view of a saw chain 1000 including the cutter link 100, in accordance with various embodiments. Although only a single instance of the cutter link 100 is illustrated in FIG. 10, the figure represents only a portion of a saw chain, and one or more cutter links shaped as discussed herein with reference to the cutter link 100 may be included in the saw chain 1000. The saw chain 1000 may also include one or more cutter links 300. The cutter link 300 may be shaped as a mirror image of the cutter link 100 and may serve as the "right-handed" version of the cutter link 100. The saw chain 1000 may further include drive links 1002 and tie straps 1004, rotatably coupled using rivets or other fasteners through rivet holes in the components (e.g., the rivet holes 122 of the cutter link 100), as known in the art.

Figure 11:
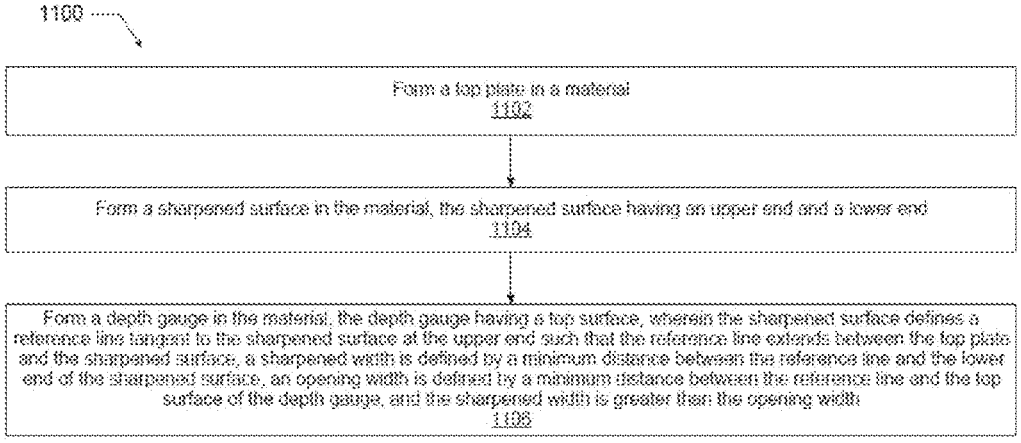
FIGS. 11 and 12 are flow diagrams of illustrative methods for manufacturing a cutter link, in accordance with various embodiments.

FIG. 11 is a flow diagram of an illustrative method 1100 for manufacturing a cutter link, in accordance with various embodiments. As noted above, although the operations discussed with reference to FIG. 11 are discussed as performed in a particular order, this is simply for the sake of illustration, and the operations may be performed in any suitable order. Additionally, the operations discussed with reference to FIG. 11 may be illustrated with reference to the cutter link 100, but the method of FIG. 11 may be used to manufacture any cutter link in accordance with its operations.

At 1102, a top plate (e.g., the top plate 102) may be formed in a material (e.g., steel). In some embodiments, the material may be stamped into a rough shape and hardened prior to the operations of the method 1100.

At 1104, a sharpened surface (e.g., the sharpened surface 104) may be formed in the material. The sharpened surface formed at 1104 may have an upper end and a lower end (e.g., the upper end 106 and the lower end 108).

At 1106, a depth gauge (e.g., the depth gauge 110) may be formed in the material. The depth gauge formed at 1106 may have a top surface (e.g., the top surface 112). The top plate (1102), the sharpened surface (1104), and the depth gauge (1106) may be formed such that the sharpened surface defines a reference line (e.g., the reference line 114) tangent to the sharpened surface at the upper end such that the reference line extends between the top plate and the sharpened surface, a sharpened width (e.g., the sharpened width 116) is defined by a minimum distance between the reference line and the lower end of the sharpened surface, an opening width (e.g., the opening width 118) is defined by a minimum distance between the reference line and the top surface of the depth gauge, and the sharpened width is greater than the opening width.

A cutter link manufactured in accordance with the method 1100 may have any suitable dimensions. For example, in some embodiments, a ratio of the opening width to the sharpened width may be approximately 0.56. In some embodiments, the opening width is approximately 0.129 inches. In some embodiments, the sharpened width is approximately 0.231 inches. In some embodiments, the chip drag coefficient of a cutter link manufactured in accordance with the method 1100 may be less than or equal to approximately 0.55. In some embodiments, the chip drag coefficient may be less than or equal to approximately 0.45. In some embodiments, the chip drag coefficient may be approximately 0.37. In some embodiments, the arc length may be approximately 0.346 inches.

Figure 12:
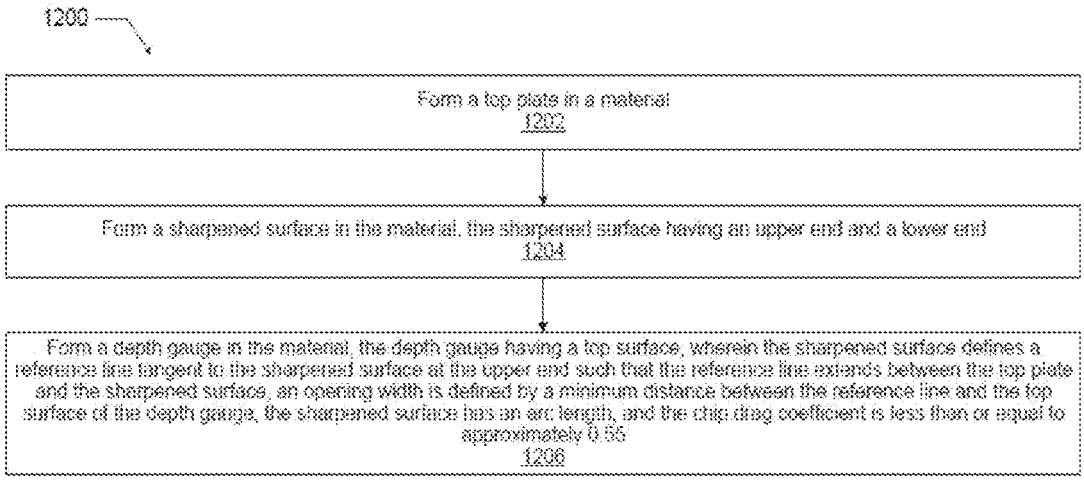

FIG. 12 is a flow diagram of an illustrative method 1200 for manufacturing a cutter link, in accordance with various embodiments. As noted above, although the operations discussed with reference to FIG. 12 are discussed as performed in a particular order, this is simply for the sake of illustration, and the operations may be performed in any suitable order. Additionally, the operations discussed with reference to FIG. 12 may be illustrated with reference to the cutter link 100, but the method of FIG. 12 may be used to manufacture any cutter link in accordance with its operations.

At 1202, a top plate (e.g., the top plate 102) may be formed in a material (e.g., steel). In some embodiments, the material may be stamped into a rough shape and hardened prior to the operations of the method 1200.

At 1204, a sharpened surface (e.g., the sharpened surface 104) may be formed in the material. The sharpened surface formed at 1204 may have an upper end and a lower end (e.g., the upper end 106 and the lower end 108).

At 1206, a depth gauge (e.g., the depth gauge 110) may be formed in the material. The depth gauge formed at 1106 may have a top surface (e.g., the top surface 112). The top plate (1202), the sharpened surface (1204), and the depth gauge (1206) may be formed such that the sharpened surface defines a reference line (e.g., the reference line 114) tangent to the sharpened surface at the upper end such that the reference line extends between the top plate and the sharpened surface, an opening width (e.g., the opening width 118) is defined by a minimum distance between the reference line and the top surface of the depth gauge, the sharpened surface has an arc length (e.g., the arc length 120), and the chip drag coefficient is less than or equal to approximately 0.55.

A cutter link manufactured in accordance with the method 1200 may have any suitable dimensions. For example, in some embodiments, the chip drag coefficient of a cutter link manufactured in accordance with the method 1200 may be less than or equal to approximately 0.45. In some embodiments, the chip drag coefficient may be approximately 0.37. In some embodiments, the arc length may be approximately 0.346 inches. In some embodiments, a cutter link may have a sharpened width (e.g., the sharpened width 116) defined by a minimum distance between the reference line and the lower end of the sharpened surface, and in some embodiments, a ratio of the opening width to the sharpened width may be approximately 0.56. In some embodiments, the opening width is approximately 0.129 inches. In some embodiments, the sharpened width is approximately 0.231 inches.

The following paragraphs describe a number of illustrative examples of some of the embodiments disclosed herein.

Example 1 is a cutter link, including: a top plate; a sharpened surface having an upper end and a lower end; and a depth gauge having a top surface; wherein: the sharpened surface defines a reference line tangent to the sharpened surface at the upper end such that the reference line extends between the top plate and the sharpened surface, a sharpened width is defined by a minimum distance between the reference line and the lower end of the sharpened surface, an opening width is defined by a minimum distance between the reference line and the top surface of the depth gauge, and the sharpened width is greater than the opening width.

Example 2 may include the subject matter of Example 1, and may further specify that a ratio of the opening width to the sharpened width is approximately 0.56.

Example 3 may include the subject matter of any of Examples 1-2, and may further specify that the opening width is approximately 0.129 inches.

Example 4 may include the subject matter of any of Examples 1-3, and may further specify that the sharpened width is approximately 0.231 inches.

Example 5 may include the subject matter of any of Examples 1-4, and may further specify that: the sharpened surface has an arc length; a chip drag coefficient is defined as equal to a ratio of the opening width to the arc length; and the chip drag coefficient is less than or equal to approximately 0.55.

Example 6 may include the subject matter of Example 5, and may further specify that the chip drag coefficient is less than or equal to approximately 0.45.

Example 7 may include the subject matter of Example 6, and may further specify that the chip drag coefficient is approximately 0.37.

Example 8 may include the subject matter of any of Examples 5-7, and may further specify that the arc length is approximately 0.346 inches.

Example 9 is a cutter link, including: a top plate; a sharpened surface extending from the top plate, the sharpened surface having an upper end and a lower end; and a depth gauge having a top surface; wherein: the sharpened surface defines a reference line tangent to the sharpened surface at the upper end such that the reference line extends between the top plate and the sharpened surface, an opening width is defined by a minimum distance between the reference line and the top surface of the depth gauge, the sharpened surface has an arc length, a chip drag coefficient is defined as equal to a ratio of the opening width to the arc length, and the chip drag coefficient is less than or equal to approximately 0.55.

Example 10 may include the subject matter of Example 9, and may further specify that the chip drag coefficient is less than or equal to approximately 0.45.

Example 11 may include the subject matter of Example 10, and may further specify that the chip drag coefficient is approximately 0.37.

Example 12 may include the subject matter of any of Examples 9-11, and may further specify that the arc length is approximately 0.346 inches.

Example 13 is a method of manufacturing a cutter link, including: forming a top plate in a material; forming a sharpened surface in the material, the sharpened surface having an upper end and a lower end; and forming a depth gauge in the material, the depth gauge having a top surface; wherein: the sharpened surface defines a reference line tangent to the sharpened surface at the upper end such that the reference line extends between the top plate and the sharpened surface, a sharpened width is defined by a minimum distance between the reference line and the lower end of the sharpened surface, an opening width is defined by a minimum distance between the reference line and the top surface of the depth gauge, and the sharpened width is greater than the opening width.

Example 14 may include the subject matter of Example 13, and may further specify that a ratio of the opening width to the sharpened width is approximately 0.56.

Example 15 may include the subject matter of any of Examples 13-14, and may further specify that the opening width is approximately 0.129 inches.

Example 16 may include the subject matter of any of Examples 13-15, and may further specify that the sharpened width is approximately 0.231 inches.

Example 17 may include the subject matter of any of Examples 13-16, and may further specify that: the sharpened surface has an arc length; a chip drag coefficient is defined as equal to a ratio of the opening width to the arc length; and the chip drag coefficient is less than or equal to approximately 0.55.

Example 18 may include the subject matter of Example 17, and may further specify that the chip drag coefficient is less than or equal to approximately 0.45.

Example 19 may include the subject matter of Example 18, and may further specify that the chip drag coefficient is approximately 0.37.

Example 20 may include the subject matter of any of Examples 17-19, and may further specify that the arc length is approximately 0.346 inches.

Example 21 is a method of manufacturing a cutter link, including: forming a top plate in a material; forming a sharpened surface in the material, the sharpened surface having an upper end and a lower end; and forming a depth gauge in the material, the depth gauge having a top surface; wherein: the sharpened surface defines a reference line tangent to the sharpened surface at the upper end such that the reference line extends between the top plate and the sharpened surface, an opening width is defined by a minimum distance between the reference line and the top surface of the depth gauge, the sharpened surface has an arc length, a chip drag coefficient is defined as equal to a ratio of the opening width to the arc length, and the chip drag coefficient is less than or equal to approximately 0.55.

Example 22 may include the subject matter of Example 21, and may further specify that the opening width is approximately 0.129 inches.

Example 23 may include the subject matter of any of Examples 21-22, and may further specify that the chip drag coefficient is less than or equal to approximately 0.45.

Example 24 may include the subject matter of any of Examples 21-23, and may further specify that the chip drag coefficient is approximately 0.37.

Example 25 may include the subject matter of any of Examples 21-24, and may further specify that the arc length is approximately 0.346 inches.

Example 26 may include the subject matter of any of Examples 21-25, and may further specify that a sharpened width is defined by a minimum distance between the reference line and the lower end of the sharpened surface, and the sharpened width is greater than the opening width.

Example 27 may include the subject matter of Example 26, and may further specify that a ratio of the opening width to the sharpened width is approximately 0.56.

Example 28 may include the subject matter of any of Examples 26-27, and may further specify that the sharpened width is approximately 0.231 inches.

What is claimed is:

1. A cutter link, comprising:

a top plate;

a depth gauge having a top surface;

and a sharpened surface having an upper end, a lower end, a sharpening axis, wherein the sharpened surface between the upper end and the lower end is substantially circular as viewed along the sharpening axis, and wherein the sharpened surface curves upward at the bottom toward the depth gauge; wherein:

the sharpened surface defines a reference line tangent to the sharpened surface at the upper end such that the reference line extends between the top plate and the sharpened surface, a sharpened width is defined by a minimum distance between the reference line and the lower end of the sharpened surface, an opening width is defined by a minimum distance between the reference line and the top surface of the depth gauge, the sharpened width is greater than the opening width, the top surface of the depth gauge is below the upper end of the sharpened surface, a chip drag coefficient defined as equal to a ratio of the opening width to the arc length, wherein the chip drag coefficient is less than or equal to approximately 0.55.

2. The cutter link of claim 1, wherein a ratio of the opening width to the sharpened width is approximately 0.56.

3. The cutter link of claim 1, wherein the opening width is approximately 0.129 inches.

4. The cutter link of claim 1, wherein the sharpened width is approximately 0.231 inches.

5. The cutter link of claim 1, wherein the chip drag coefficient is less than or equal to approximately 0.45.

6. The cutter link of claim 5, wherein the chip drag coefficient is approximately 0.37.

7. The cutter link of claim 1, wherein the arc length is approximately 0.346 inches.

8. A method of manufacturing a cutter link, comprising:

forming a top plate in a material;

and forming a depth gauge in the material, the depth gauge having a top surface forming a sharpened surface in the material along a sharpening axis, the sharpened surface having an upper end and a lower end, wherein the sharpened surface between the upper end and the lower end is substantially circular as viewed along the sharpening axis, and wherein the sharpened surface curves upward at the bottom end;

wherein:

the sharpened surface defines a reference line tangent to the sharpened surface at the upper end such that the reference line extends between the top plate and the sharpened surface, a sharpened width is defined by a minimum distance between the reference line and the lower end of the sharpened surface, an opening width is defined by a minimum distance between the reference line and the top surface of the depth gauge, the sharpened width is greater than the opening width, the top surface of the depth gauge is below the upper end of the sharpened surface, and a chip drag coefficient is defined as equal to a ratio of the opening width to the arc length and the chip drag coefficient is less than or equal to approximately 0.55.

9. The method of claim 8, wherein a ratio of the opening width to the sharpened width is approximately 0.56.

10. The method of claim 8, wherein the opening width is approximately 0.129 inches.

11. The method of claim 8, wherein the sharpened width is approximately 0.231 inches.

12. The method of claim 8, wherein the chip drag coefficient is less than or equal to approximately 0.45.

13. The method of claim 12, wherein the chip drag coefficient is approximately 0.37.

14. The method of claim 8, wherein the arc length is approximately 0.346 inches.

* * * * *